US006425474B2

(12) United States Patent
Spatafora

(10) Patent No.: US 6,425,474 B2
(45) Date of Patent: Jul. 30, 2002

(54) CONVEYOR FOR CONVEYING ARTICLES ON AN AUTOMATIC WRAPPING MACHINE

(75) Inventor: Mario Spatafora, Via del Lavoro (IT)

(73) Assignee: G.D Societa' per Azioni, Via Pomponia (IT)

( * ) Notice: Subject to any disclaimer, the term of this patent is extended or adjusted under 35 U.S.C. 154(b) by 0 days.

(21) Appl. No.: 09/932,608

(22) Filed: Aug. 17, 2001

Related U.S. Application Data

(63) Continuation of application No. PCT/IT00/00039, filed on Feb. 11, 2000.

(30) Foreign Application Priority Data

Feb. 17, 1999 (IT) ..... B099A 000067

(51) Int. Cl.[7] ..... B65B 37/00

(52) U.S. Cl. ..... 198/346.2; 198/418

(58) Field of Search ..... 198/346.1, 346.2, 198/418, 418.1, 468.01; 414/266, 788

(56) References Cited

U.S. PATENT DOCUMENTS 3,771,279 A 11/1973 Seragnoli
5,988,353 A * 11/1999 Asai et al. ..... 198/468.4

FOREIGN PATENT DOCUMENTS

FR 1 575 729 A 7/1969

* cited by examiner

*Primary Examiner*—Kenneth W. Noland
(74) *Attorney, Agent, or Firm*—Marshall, Gerstein & Borun

(57) ABSTRACT

A conveyor for conveying articles has a number of pockets movable along a path. A primary of a linear electric motor is located along at least one portion of the path. A secondary of the linear electric motor is associated with each pocket to feed the pocket along the portion of the path.

18 Claims, 3 Drawing Sheets

CONVEYOR FOR CONVEYING ARTICLES ON AN AUTOMATIC WRAPPING MACHINE

This is a continuation of international application PCT/IT00/00039, filed Feb. 11, 2000.

TECHNICAL FIELD

The present invention relates to a conveyor. In particular, the present invention relates to a conveyor for conveying articles on an automatic wrapping machine, to which the following description refers purely by way of example.

BACKGROUND ART

Known automatic wrapping machines normally comprise a number of conveyors arranged in succession and defining a path for the articles. Each conveyor comprises pockets for housing the articles, which are transferred from one conveyor to the next. More specifically, known automatic machines comprise an input conveyor for receiving the articles to be wrapped, and an output conveyor for unloading the wrapped articles.

The conveyors of known automatic machines are normally step-operated, while more recent machines are equipped with continuously-operated conveyors. This important innovation, while enabling higher output of more recent automatic machines as compared with those featuring step-operated conveyors, has also complicated transfer of the articles from one conveyor to the next. That is, transferring articles between two continuously-operated conveyors calls for setting the pockets of the two substantially tangent conveyors to given positions for given lengths of time at a transfer station, which in turn calls for relatively complex actuating mechanisms.

Moreover, some articles cannot be supplied continuously on account of the fragile nature or other particular characteristics of the articles, so that the machines are equipped with both continuously- and step-operated conveyors, thus complicating transfer of the articles from one conveyor to the next.

DISCLOSURE OF INVENTION

It is an object of the present invention to provide a conveyor designed to eliminate the aforementioned drawbacks, and which, in particular, is straightforward mechanically.

According to the present invention, there is provided a conveyor for conveying articles and comprising a number of pockets movable along a path; said conveyor being characterized by comprising at least one primary of a linear electric motor located along at least one portion of said path; and a secondary of said linear electric motor associated with each pocket to feed the, pocket along said portion of the path.

Using a magnetic field to propel the pockets of the conveyor provides, on the one hand, for imparting any shape to the path of conveyor without recourse to complex mechanisms, and, on the other, for feeding the pockets along the path with any law of motion.

The present invention also relates to an automatic machine.

According to the present invention, there is provided an automatic machine comprising a conveyor for conveying articles and in turn comprising a number of pockets movable along a path; said conveyor being characterized by comprising at least one primary of a linear electric motor located along at least one portion of said path, and a secondary of said linear electric motor associated with each pocket to feed the pocket along said portion of the path; and said machine being characterized by comprising at least one further conveyor for feeding said articles along at least one further path cooperating with said path.

BRIEF DESCRIPTION OF THE DRAWINGS

Two non-limiting embodiments of the present invention will be described by way of example with reference to the accompanying drawings, in which.

BEST MODE FOR CARRYING OUT THE INVENTION

Figure 1:
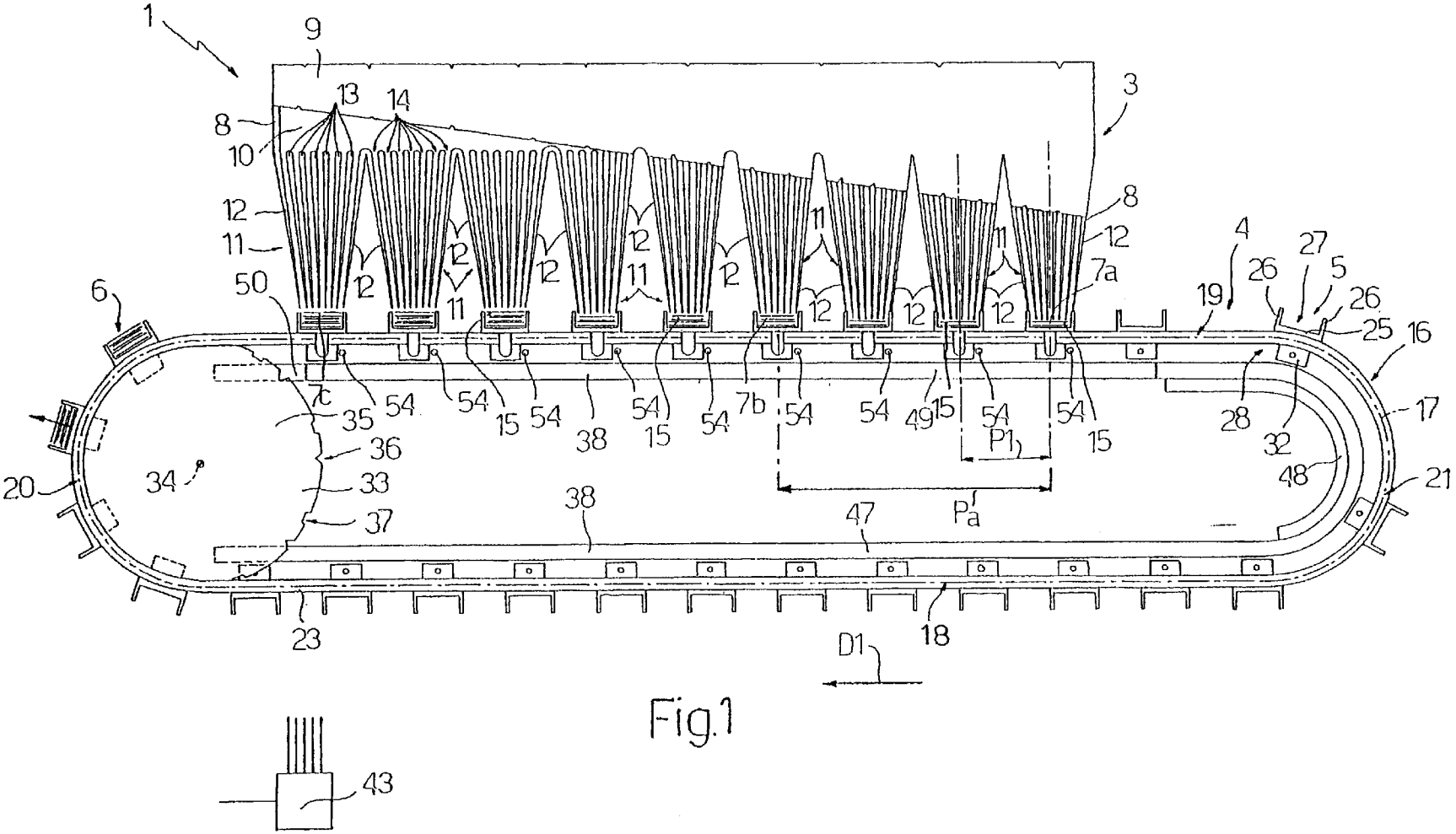
FIG. 1 shows a lateral elevation, with parts removed for clarity, of an automatic machine featuring the conveyor according to the present invention.

Number 1 in FIG. 1 indicates an automatic machine for producing known packets (not shown) of cigarettes 2.

Machine 1 comprises a hopper 3 for supplying cigarettes 2; and a conveyor 4 in turn comprising a number of pockets 5 for housing respective groups 6 of cigarettes 2, each group 6 being defined by twenty cigarettes 2 arranged in three superimposed layers 7*a*, 7*b* and 7*c*. Layer 7*b* comprises six parallel, side by side cigarettes 2 and is located between layers 7*a* and 7*c*, each of which comprises seven parallel, side by side cigarettes 2.

Hopper 3 comprises two lateral walls 8, a front wall 9, a rear wall 10 and nine outlets 11, and houses a mass of cigarettes 2 oriented with the respective axes (not shown) perpendicular to the FIG. 1 plane. Each outlet 11 comprises two lateral walls 12 and a number of partitions 13 which, together with walls 12, define a number of downflow channels 14 for cigarettes 2. Each outlet 11 is defined at the bottom end by a respective platform 15 onto which cigarettes 2 issuing from respective channels 14 come to rest in orderly manner to form, on platform 15, a respective layer 7*a*, 7*b*, 7*c*. Outlets 11 are spaced with a given spacing P1 in a horizontal direction D1 crosswise with respect to cigarettes 2.

Conveyor 4 is an endless conveyor and comprises an endless guide 16 supporting pockets 5 in sliding manner and defining an endless path 17. Path 17 comprises a straight bottom branch 18, a straight top branch 19 parallel to branch 18, and two curved branches 20 and 21 connecting branches 18 and 19 at respective opposite ends of conveyor 4 in direction D1.

Figure 4:
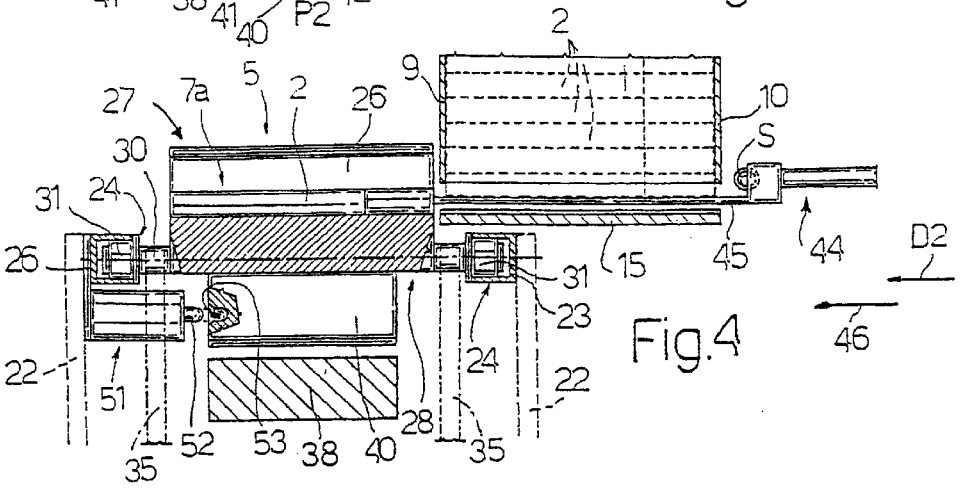
FIG. 4 shows a larger-scale section of the FIG. 3 automatic machine along line IV—IV.

With reference to FIG. 4, conveyor 4 comprises two parallel facing supporting plates 22 perpendicular to the FIG. 4 plane and respectively supporting two endless parallel facing rails 23, which have two respective opposite seats 24 and together form guide 16.

Figure 2:
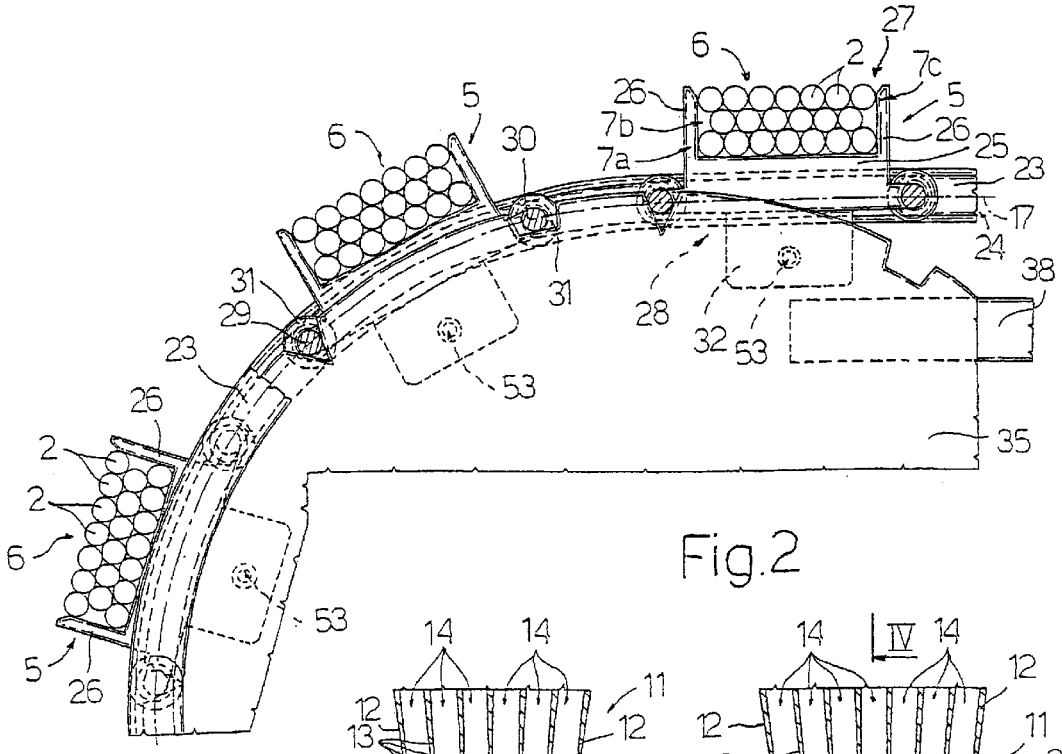
FIG. 2 shows a larger-scale lateral elevation, with parts removed for clarity and parts in section, of a detail of the FIG. 1 conveyor.
Figure 3:
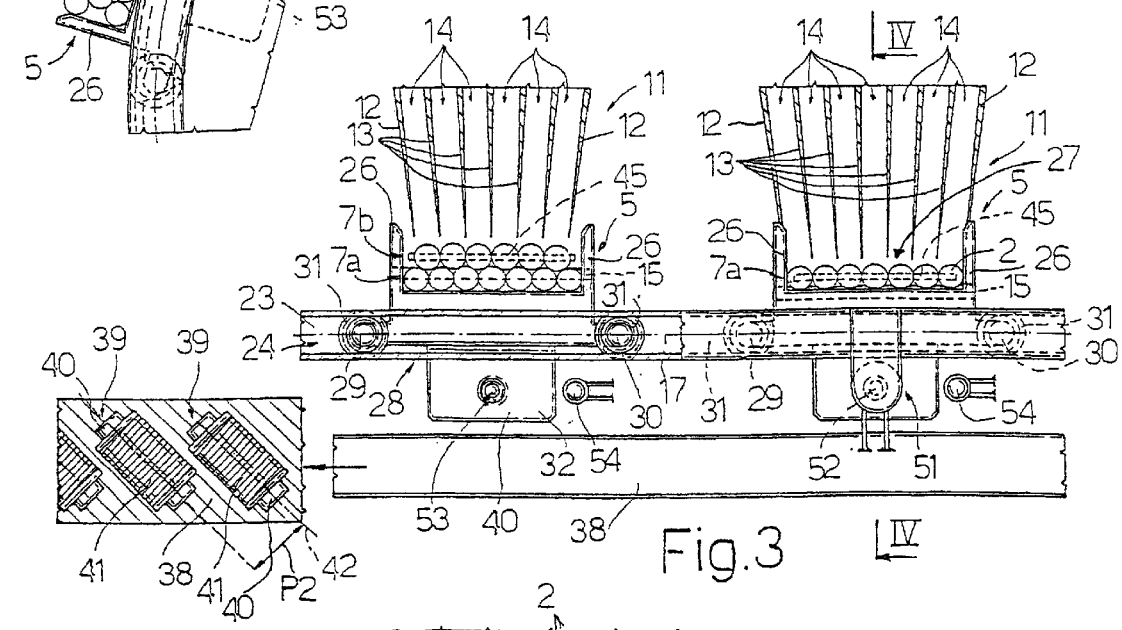
FIG. 3 shows a larger-scale lateral elevation, with parts removed for clarity and parts in section, of a detail of the FIG. 1 conveyor.

With reference to FIGS. 2, 3 and 4, each pocket 5 comprises a bottom wall 25, and two parallel facing lateral walls 26 extending crosswise with respect to wall 25 and defining, together with wall 25, a seat 27 for housing a respective group 6. Each pocket 5 also comprises a respective carriage 28 integral with bottom wall 25 and in turn comprising two shafts 29 and 30, which are perpendicular to the FIG. 2 and 3 plane, are parallel to each other, have a center distance of given length., and are fitted on the ends with wheels 31 engaging seats 24 in respective rails 23. Hereinafter, shafts 29 and 30 are referred to, with reference to direction D1, as front shaft 29 and rear shaft 30. Each carriage 28 also supports a block 32 made of copper or other type of conducting material, and which extends from the opposite side of bottom wall 25 with respect to lateral walls 26.

With reference to FIG. 1, conveyor 4 comprises a pulley 33 rotating anticlockwise in FIG. 1 about a respective axis 34 perpendicular to the FIG. 1 plane. Pulley 33 comprises two parallel facing circular walls 35 perpendicular to axis 34, and each having a number of notches 36 and 37 formed along the peripheral edge of wall 35. Notches 36 are equally spaced about axis 34 with a spacing equal to spacing P1 of outlets 11; similarly, notches 37 are equally spaced about axis 34 with a spacing equal to spacing P1; and each notch 37 is located upstream from a respective notch 36 in the anticlockwise rotation direction of pulley 33 in FIGS. 1 and 2 Each notch 36 on one wall 35 is V-shaped, houses a portion of front shaft 29 of a respective pocket 5, and is timed with respect to a respective notch 36 formed on the opposite wall 35 and for housing a portion of the same front shaft 29 of the same pocket 5. In substantially the same way, each notch 37 on one wall 35 is truncated-V-shaped, houses a portion of the rear shaft 30 of the same pocket 5, and is timed with respect to a respective notch 37 formed on the opposite wall 35 and for housing a portion of the same rear shaft 30 of the same pocket 5. As such, carriage 28 and respective pocket 5 are guided by pulley 33 along curved branch 20.

With reference to FIGS. 1, 3 and 4, conveyor 4 also comprises a magnetic-field generator 38 in turn comprising an elongated U-shaped body and extending substantially along bottom branch 18, top branch 19 and curved branch 21 of path 17. With reference to FIG. 3, generator 38 comprises a succession of inductors 39 equally spaced with a spacing P2 (relatively small and much smaller than spacing P1 of outlets 11) along branches 18, 19 and 21. Each inductor 39 comprises a straight ferromagnetic body 40 and an electric winding 41 wound about body 40, and has an axis 42 of orientation of the magnetic field B, which in fact corresponds to the orientation of body 40. Each inductor 39 generates a magnetic field B which extends along body 40 along axis 42, comes out of body 40 and closes into a loop in the space surrounding body 40. Axis 42 of each inductor 39 forms an angle of 5° to 85° with the portion of path 17 adjacent to inductor 39, so that, on intercepting said portion of path 17, magnetic field B has a component parallel to and a component perpendicular to said portion of path 17.

In actual fact, inductors 39 form the primary or stator of a linear electric motor, while each block 32 forms the secondary of the linear electric motor, so that the action of magnetic field B on each block 32 generates on block 32 a force having a trajectory parallel to path 17 and a direction which is switchable to selectively accelerate or decelerate respective carriage 28. In other embodiments not shown, the primary and secondary of the linear electric motor associated with each carriage 28 are formed differently in known manner.

With reference to FIG. 1, each inductor 39 is connected to a central control unit 43 for varying the supply current of each inductor 39 according to the position of each carriage 28 along path 17.

With reference to FIG. 4, in addition to hopper 3 and conveyor 4, machine 1 also comprises a pusher 44 in turn comprising nine movable plates 45, only one of which is shown in FIG. 4. Each plate 45 is movable back and forth in a direction D2 perpendicular to direction D1 to push one of layers 7*a*, 7*b*, 7*c* from platform 15 into a respective pocket 5 along a respective path 46 perpendicular to path 17. The position of each plate 45 is determined by a position sensor S, which supplies central control unit 43 with a signal indicating the position of respective plate 45.

With reference to FIG. 1, generator 38 comprises a portion 47 parallel to branch 18; a portion 48 parallel to branch 21 and to a portion of branch 19 adjacent to branch 21; a portion 49 parallel to branch 19 and located at outlets 11; and a portion 50 located at branch 19, close to pulley 33.

Central control unit 43 activates inductors 39 to feed pockets 5 continuously and at constant speed along branch 18, to feed pockets 5 continuously and at increasing speed along branch 48, to feed pockets 5 in steps along branch 49, and to accelerate pockets 5 towards pulley 33 along portion 50.

At each outlet 11, conveyor 4 also comprises an electromagnet 51, which is activated by central control unit 43 and controls a locating pin 52 movable between a withdrawn rest position and an extracted work position in which pin 52 engages a cavity 53 formed in carriage 28 of each pocket 5 to lock pocket 5 in a given position at outlet 11.

A sensor 54 is provided at each outlet 11 to determine the passage of pockets 5 directly upstream from outlet 11 in direction D1, and to transmit a respective signal to central control unit 43 which provides for supplying inductors 39 to feed pockets 5 forward.

In actual use, cigarettes 2 drop by force of gravity down channels 14 of outlets 11 and onto platforms 15 to form layers 7*a*, 7*b*, 7*c*, which are transferred from platforms 15 to pockets 5 along respective paths 46 by moving plates 45 in direction D2 from the rest position (not shown) towards pockets 5 and into the position shown in FIG. 4.

Pockets 5 are stopped at outlets 11 along branch 19 to enable insertion of layers 7*a*, 7*b*, 7*c* inside respective seats 27. With reference to FIG. 1, the first three outlets 11 from right to left form layers 7*a*, which are transferred into seats 27 and onto the respective bottom walls 25 of three pockets 5 arrested at the first three outlets 11. The three pockets 5 are locked in given positions at respective outlets 11 by means of pins 52 inserted inside respective cavities 53 of the-three pockets 5, and, once respective layers 7*a* are transferred, are fed forward one step Pa, of a length equal to three times the spacing P1 of outlets 11, up to three respective intermediate outlets 11 where pockets 5 are again locked in given positions by respective pins 52. The three intermediate outlets 11 supply layers 7*b*, which rest on respective platforms 15 and are transferred by respective plates 45 into seats 27 and onto respective layers 7*a*. Once layers 7*b* are transferred, pins 52 are withdrawn and the three pockets 5 are fed forward one step Pa up to the three outlets 11 on the left in FIG. 1 to receive layers 7*c*, which are deposited onto layers 7*b* to simultaneously complete three groups 6.

Once groups 6 are formed, each pocket 5 is accelerated by the magnetic field B generated by portion 50 and is fed to pulley 33, which rotates at constant speed about respective axis 34 and successively positions notches 36 and 37 to respectively engage front shaft 29 and rear shaft 30 of carriage 28 of pocket 5. Pockets 5 are fed mechanically along portion 20 of path 17 by pulley 33 drawing pockets 5 along guide 16, which mechanical feed provides for restoring the equal spacing and so correcting any errors in the positioning of pockets 5.

Pulley 33 releases pockets 5 along branch 18, along which the magnetic field B generated by respective inductors 39 feeds pockets 5 forward at constant speed so that pockets 5 are maintained equally spaced with spacing P1. At portion 21, pockets 5 are accelerated up to branch 19 to rapidly take the place of the three pockets 5 transferred from the first three outlets 11 to the three intermediate outlets 11.

In other words, layers 7*a*, 7*b*, 7*c* are formed in steps, thus ensuring cigarettes 2 undergo no damage during the formation of layers 7*a*, 7*b*, 7*c*; and layers 7*a*, 7*b*, 7*c* are also transferred in steps to pockets 5 of conveyor 4, which is therefore operated partly in steps and partly continuously in an extremely straightforward manner.

Each linear motor defined by inductors 39 and by a respective block 32 is open-loop controlled by central control unit 43 along the portions of path 17 not requiring precise positioning of carriages 28 (e.g. portion 47), and is closed-loop controlled along the portions of path 17 requiring precise positioning of carriages 28, e.g. portion 49, along which the position-control feedback signals are supplied by sensors 54.

Figure 5:
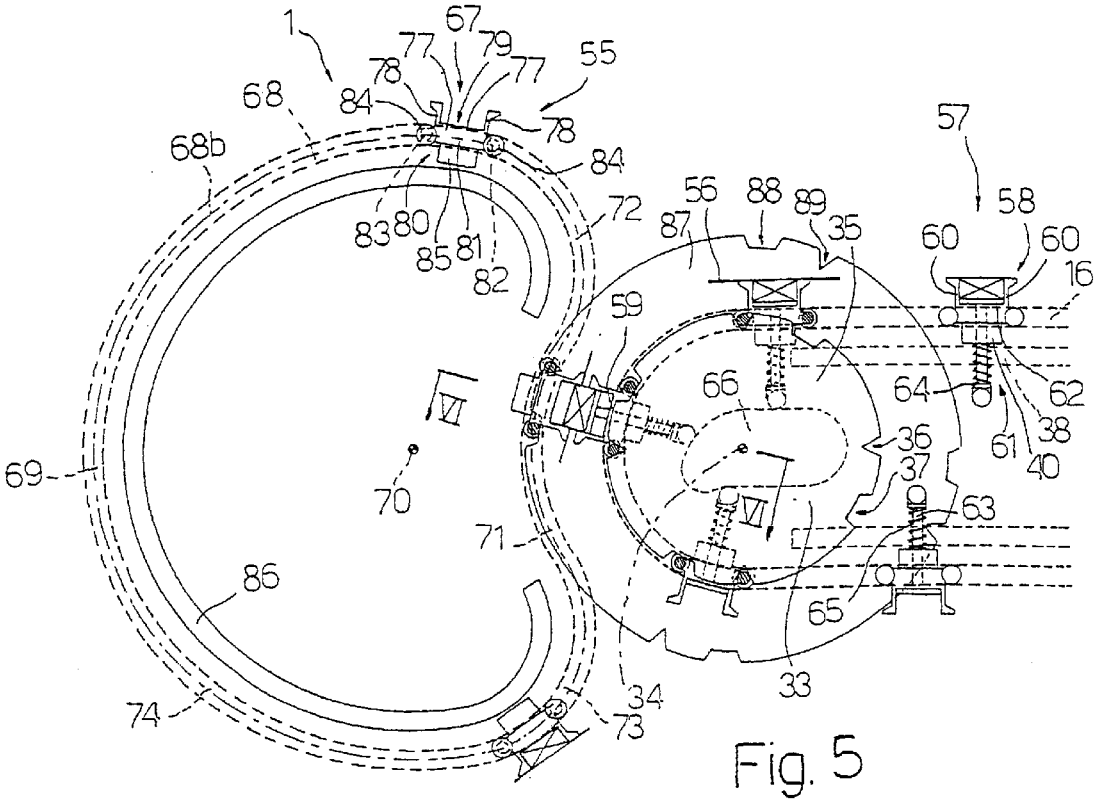
FIG. 5 shows a lateral elevation, with parts removed for clarity, of the FIG. 1 automatic machine featuring conveyors according to a variation of the present invention.

In the FIG. 5 variation, machine 1 comprises a wrapping conveyor 55 for wrapping a group 6 of cigarettes in a sheet 56 of wrapping material. Conveyor 55 cooperates with a conveyor 57 for forming groups 6 and which, though similar, features a number of variations with respect to conveyor 4 described with reference to FIGS. 1, 2, 3 and 4.

On conveyor 57, pockets 5 are replaced by pockets 58, which are fed along path 17 in substantially the same way as pockets 5. Each pocket 58 comprises a bottom wall 59; two lateral walls 60 having known suction holes (not shown) at the opposite ends; and a pusher 61 in turn comprising a plate 62 contacting wall 59 in a rest position, and a rod 63 for controlling plate 62. Rod 63 comprises a projection 64 on which rests a spring 65 located between projection 64 and bottom wall 59 to keep plate 62 in the rest position contacting wall 59. Pocket 58 is integral with carriage 28, which slides between rails 23 along guide 16.

Pulley 33 comprises a fixed cam 66 located between walls 35 and cooperating with the free end of rod 63 to detach plate 62 from wall 59 and expel group 6 from respective pocket 58.

Machine 1 also comprises a known device (not shown) for cutting and supplying sheets 56 to respective pockets, 58 containing respective groups 6. Each sheet 56 is deposited onto the free ends of lateral walls 60 and is retained by the known suction holes not shown.

Wrapping conveyor 55 comprises a number of pockets 67 movable along an endless substantially bean-shaped guide 68 defining a path 68*b* for pockets 67. In particular, guide 68 comprises a circular portion 69 extending about an axis 70 parallel to axis 34; a circular portion 71 extending about axis 34; and two connecting portions 72 and 73 connecting portions 69 and 71. Pockets 67 are fed along path 68*b* clockwise about axis 70 in FIG. 5.

Figure 6:
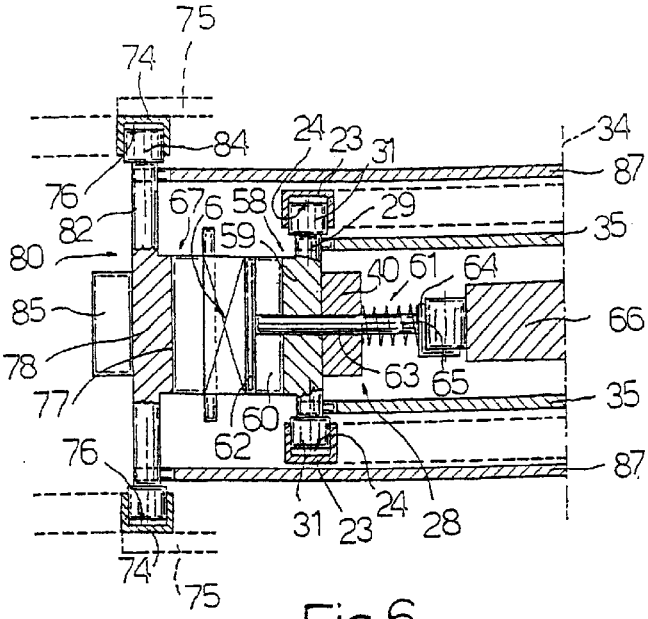
FIG. 6 shows a larger-scale section along line VI—VI in FIG. 5.

With reference to FIG. 6, guide 68 comprises two rails 74 supported by two parallel facing plates 75 and having respective seats 76.

Each pocket 67 comprises a bottom wall 77, and two lateral walls 78 which, together with bottom wall 77, define a seat 79. Each pocket 67 is integral with a respective carriage 80 comprising a central body 81 from which extend two shafts 82 and 83, each of which is fitted on the ends with two wheels 84 engaging seats 76 of respective rails 74. Carriage 80 also comprises a body 85 made of copper or other conducting material and extending on the opposite side of central body 81 with respect to lateral walls 78.

Conveyor 55 comprises a magnetic-field generator 86 extending along portions 69, 72 and 73, and which, like generator 38, generates a magnetic field B for feeding pockets 67 along portions 69, 72 and 73 of guide 68.

With reference to FIGS. 5 and 6, in addition to walls 35, pulley 33 also comprises two circular walls 87, which are parallel to walls 35, are larger in diameter than walls 35, and are located outwards with respect to walls 35. Walls 87 rotate integrally with walls 35 about axis 34 and, like walls 35, each comprise a number of notches 88 and 89 for receiving shafts 82 and 83 of pockets 67 and feeding pockets 67 along portion 71 by means of pulley 33. Notches 88 and 89 are located, with respect to notches 36 and 37, so that each pocket 67 is fed along portion 71 facing a respective pocket 58.

In actual use, conveyor 57 feeds pockets 58 containing respective groups 6 past the known device (not shown) for supplying sheets 56, so as to successively receive respective sheets 56, which are retained on respective groups 6 by the suction holes in walls 60 and are fed, together with respective groups 6, to conveyor 55.

Along portion 20, each pocket 58 is fed about axis 34 by pulley 33, and each pocket 67 is fed about axis 34 by pulley 33 so that each pocket 67 is parallel to and faces a respective pocket 58; in the course of which travel, pusher 61, as described previously, expels group 6 from respective pocket 58 and into the respective pocket 67 facing and parallel to pocket 58. As group 6 is inserted inside pocket 67, respective sheet 56 is drawn along by group 6 and folded into a U about group 6 inside pocket 67, and is subsequently subjected to further known folding operations along path 68*b*.

In the above variation, though pockets 58 and 67 are not fed forward by inductors 39 during transfer of groups 6, the presence of inductors 39 nevertheless affords advantages, particularly as regards wrapping conveyor 55, by magnetic generator 86 enabling a path 68*b* of conveyor 55 departing considerably from a circular path with no mechanical complications involved. What is more, a substantially bean-shaped path 68*b* is decisive in implementing the type of transfer described above.

What is claimed is:

1. A conveyor for conveying articles and comprising a number of pockets (5; 67) movable along a path (17; 68*b*); said conveyor (4; 55) being characterized by comprising at least one primary (38; 86) of a linear electric motor located along at least one portion (18,19,21; 69,72,73) of said path (18; 68*b*); and a secondary of said linear electric motor associated with each pocket (5; 67) to feed the pocket (5; 67) along said portion (18,19,21; 69,72,73) of the path (17; 68*b*).

2. A conveyor as claimed in claim 1, characterized by comprising a guide (16; 68) located along said path (17; 68*b*); said pockets (5; 67) each comprising a carriage (28; 80) engaging said guide (16; 68).

3. A conveyor as claimed in claim 1, characterized by comprising a mechanical actuating device (33) for feeding said pockets (5; 67) along a further portion (20; 71) of said path (17; 68*b*); said actuating device (33) and said carriage (28; 80) comprising connecting means (36, 37, 29, 30; 88, 89, 82, 83).

4. A conveyor as claimed in claim 1, characterized in that said primary (38, 86) comprises a number of inductors (39) equally spaced at said portion (18, 19, 21; 69, 72, 73).

5. A conveyor as claimed in claim 1, characterized in that at least one transfer station for said articles (7*a*, 7*b*, 7*c*; 6) is located along said path (17; 68*b*).

6. A conveyor as claimed in claim 5, characterized in that said transfer station is located along said portion (19) of the path (17; 68*b*).

7. A conveyor as claimed in claim 6, characterized by comprising stop means (51, 52) at said transfer station along said portion (19) to stop said pockets (5) in at least one given position.

8. A conveyor as claimed in claim 6, characterized by comprising a number of said stop means (51, 52) equally spaced along said portion (19) at said transfer station to stop a respective number of pockets (5) in respective given positions.

9. A conveyor as claimed in claim 5, characterized in that said transfer station is located along said further portion (71) of said path (68*b*).

10. An automatic machine comprising a conveyor (4, 55) in accordance with claim 1, said machine being characterized by comprising at least one further conveyor (44; 57) for feeding said articles (7*a*, 7*b*, 7*c*; 6) along at least one further path (46; 17) cooperating with said path (17; 68*b*).

11. A machine as claimed in claim 10, characterized in that said further path (46) is perpendicular to said path (17).

12. A machine as claimed in claim 11, characterized in that said further path (46) intersects said path (17) at a given point along said portion (19); said conveyor (4) comprising stop means (51, 52) for arresting said pockets (5) in succession at said given point.

13. A machine as claimed in claim 10, characterized by comprising a number of further conveyors (44) for feeding said articles (7*a*, 7*b*, 7*c*) along respective further paths (46) perpendicular to said path (17); said further paths (46) intersecting said path (17) at a number of points of intersection.

14. A machine as claimed in claim 13, characterized in that said conveyor (4) comprises a number of stop means (51, 52) located at respective points of intersection along said portion (19) to arrest respective pockets (5) at said points of intersection.

15. A machine as claimed in claim 14, characterized in that said articles (7*a*, 7*b*, 7*c*) are layers (7*a*, 7*b*, 7*c*) of cigarettes (2); said conveyor (4) being a conveyor (4) for forming groups (6) of cigarettes; each group comprising superimposed layers (7*a*, 7*b*, 7*c*); and said further conveyors being pushers (44), each for pushing a respective layer (7*a*, 7*b*, 7*c*) into a pocket (5).

16. A machine as claimed in claim 10, characterized in that said further path (17) is substantially parallel to said path (68*b*) at least along respective portions of said path (68*b*) and said further path (17).

17. A machine as claimed in claim 16, characterized in that said further conveyor (57) comprises a number of further pockets (58) movable along said further path (17) along a further guide (16) extending along said further path (17).

18. A machine as claimed in claim 17, characterized by comprising a mechanical actuator (33) common to said conveyor (55) and to said further conveyor (57) to feed said pockets (67) along said guide (68) of said conveyor (55) and said further pockets (58) along the further guide (16) of said further conveyor (57).

* * * * *